US005621988A

United States Patent [19]

Bouleau et al.

[11] Patent Number: 5,621,988

[45] Date of Patent: Apr. 22, 1997

[54] VALVES FOR REMOVABLE TANK OF STEAM IRON

[75] Inventors: Jean-Paul A. A. Bouleau, Champfleur; Gerard L. H. Guillot, Radon, both of France

[73] Assignee: Moulinex, Bagnolet, France

[21] Appl. No.: 591,540

[22] PCT Filed: Aug. 10, 1994

[86] PCT No.: PCT/FR94/00994

§ 371 Date: Feb. 6, 1996

§ 102(e) Date: Feb. 6, 1996

[87] PCT Pub. No.: WO95/05503

PCT Pub. Date: Feb. 23, 1995

[30] Foreign Application Priority Data

Aug. 12, 1993 [FR] France ..... 93 09915

[51] Int. Cl.[6] ..... D06F 75/18

[52] U.S. Cl. ..... 38/77.3

[58] Field of Search ..... 38/77.3, 77.8, 38/77.82, 77.83, 88, 94; 251/318, 321, 322, 323, 353, 337, 354

[56] References Cited

U.S. PATENT DOCUMENTS

| | | | |
|---|---|---|---|
| 4,578,884 | 4/1986 | Nakao | 38/77.3 |
| 5,398,434 | 3/1995 | Biancalani | 38/77.3 |

FOREIGN PATENT DOCUMENTS

| | | | |
|---|---|---|---|
| 0493765 | 7/1992 | European Pat. Off. . | |
| 0553065 | 7/1993 | European Pat. Off. . | |
| 2653455 | 4/1991 | France . | |
| 58-29498 | 2/1983 | Japan . | |
| 1162991 | 7/1986 | Japan | 38/77.8 |
| 2156992 | 6/1990 | Japan | 38/77.83 |
| 2191498 | 7/1990 | Japan . | |
| 2243200 | 9/1990 | Japan | 38/77.83 |

*Primary Examiner*—Ismael Izaguirre
*Attorney, Agent, or Firm*—Young & Thompson

[57] ABSTRACT

A steam iron comprising a housing (1) containing a removable water supply chamber (7), a distribution chamber (6) containing a drip feed device (15) and having an opening (16) connected to the water supply chamber (7), two valves (18 and 19) provided at the opening (16) and the water supply chamber (7) respectively, and two reciprocal valve actuation members (20 and 21) for actuating the valves (18 and 19) when the chamber (7) is secured within the housing (1). One valve (18) comprises a movable plug (22) and a stationary seat (23), while the other valve (19) comprises a stationary plug (24) and a movable seat (25), and the two reciprocal actuation members (20 and 21) are designed to engage both the movable plug (22) and the movable seat (25) when the chamber (7) is secured within the housing (1).

7 Claims, 3 Drawing Sheets

VALVES FOR REMOVABLE TANK OF STEAM IRON

FIELD OF THE INVENTION

The invention concerns a steam iron comprising a casing in which there is mounted removably a water reservoir which comprises means for locking the reservoir in the casing, a filling orifice formed in its top part, and a water outlet orifice which is formed in its bottom part, a distribution chamber in which a drip feed device is mounted and the opening of which is intended to communicate with the water outlet orifice through a pipe, two valves being fitted respectively to the opening in the distribution chamber and the water outlet orifice, and two reciprocal means for actuating the said valves suitable for opening the said valves when the reservoir is locked in the casing.

In steam irons of known types, when the removable water reservoir is taken out, the valves used must completely close off the opening in the distribution chamber and the water outlet orifice in the reservoir in order to avoid any watertightness problem, but the valves do not by themselves ensure perfect watertightness and generally necessitate the use of sealing joints. In addition, when the removable reservoir is put in position, the watertightness must be perfect in order to prevent any leakage detrimental to the ironing conditions. Spring-operated valves, opening automatically when the reservoir is in place and closing when the reservoir is taken out, are generally used, but these valves deteriorate in use, no longer completely fulfilling their sealing function. All the existing solutions require many parts and are difficult to implement, particularly with regard to assembly. These solutions also have the disadvantage of increasing the cost price of the iron.

SUMMARY OF THE INVENTION

The aim of the invention is to remedy the above-mentioned drawbacks by using a connection between the distribution chamber and the removable reservoir which is both simple and economical in design and which ensures complete watertightness when the removable reservoir is taken out of the iron or when the reservoir is put in position.

According to the invention, one of the valves has a movable shutter and a fixed seat, the other valve has a fixed shutter and a movable seat, and the two reciprocal actuating means are adapted for coming into engagement, when the reservoir is locked in the casing, on the one hand with the movable shutter and on the other hand with the movable seat.

According to another characteristic of the invention, the valve with the fixed shutter and movable seat comprises a sleeve mounted so as to be movable and having an annular shoulder forming the movable seat for the fixed shutter and able to occupy two positions in which either the sleeve occupies a first position in which the reservoir is disconnected from the casing and the movable seat is in contact with the fixed shutter to form a watertight joint, or the sleeve occupies a second position in which the reservoir is fixed by the locking means and the fixed shutter opens the movable shutter so that the water in the reservoir flows freely into the distribution chamber.

By virtue of the invention, the number of parts used to provide on the one hand the watertightness and on the other hand the connection between the distribution chamber and the removable reservoir, is reduced to one only, which on the one hand simplifies the assembly and manufacture of the iron and on the other hand reduces the cost price of the said iron.

BRIEF DESCRIPTION OF THE DRAWINGS

The characteristics and advantages of the invention will moreover emerge from the following description, given by way of non-limitative example, with reference to the accompanying drawings in which.

BRIEF DESCRIPTION OF THE INVENTION

Figure 1:
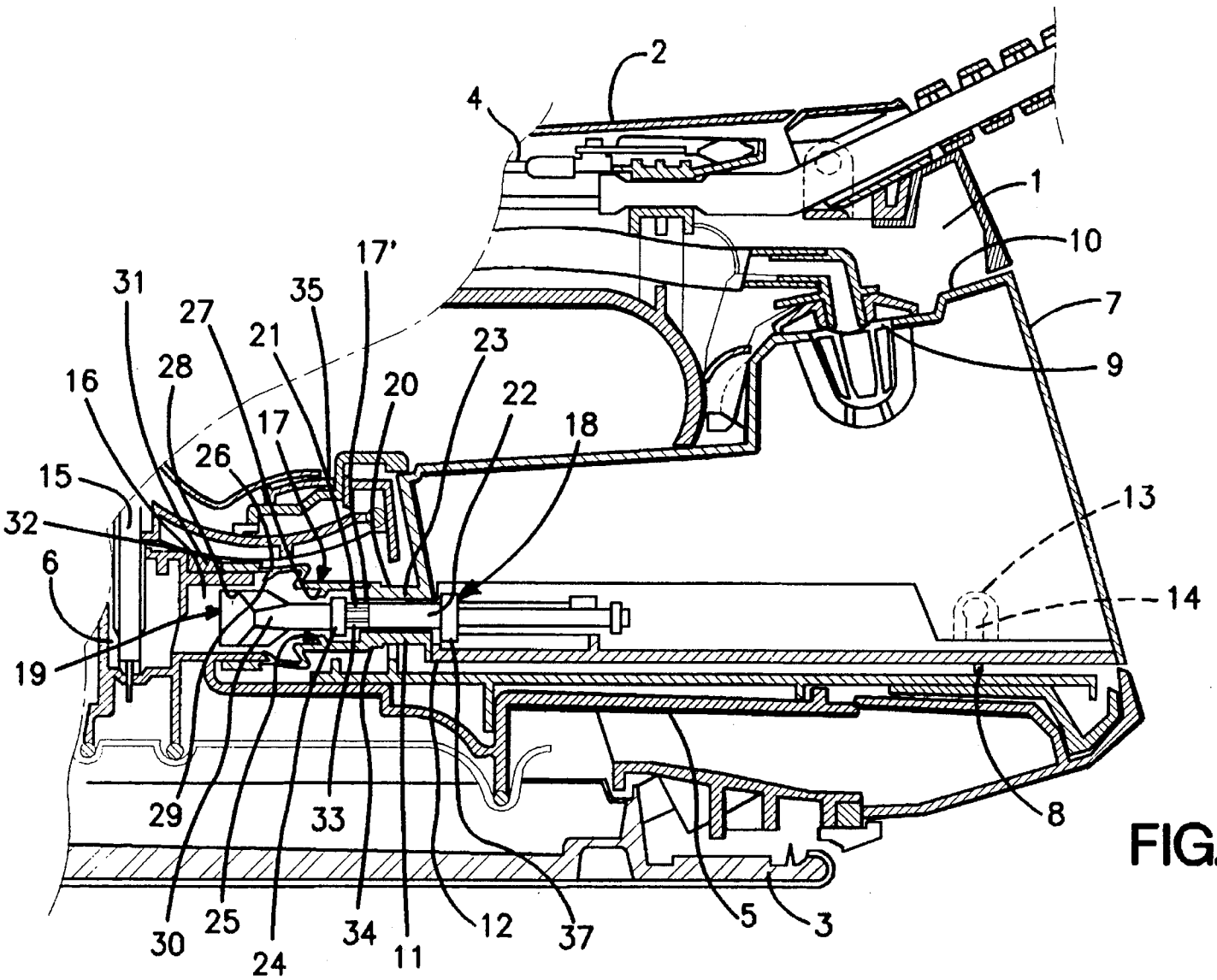
FIG. 1 is a partial view in cross section of a steam iron according to the invention.

According to FIG. 1, a steam iron comprises a casing 1 provided with a handle 2, a hot sole plate 3 of a known type, fed by an electric cable 4, a thermal shield 5 separating the sole plate 3 from the casing 1 and receiving a distribution chamber 6, and a water reservoir 7 mounted removably in the casing 1. The water reservoir 7 comprises means 8 for locking the said reservoir 7 in the casing 1, a filling orifice 9 formed in the top part 10 of the reservoir 7 and a water outlet orifice 11 which is formed in its lower part 12.

The locking means 8 include flexible hooks 13 fixed to the walls of the reservoir 7, which come into engagement in notches (not shown) formed in the casing 1 so that the reservoir 7 is securely locked in the casing 1 of the iron when it is correctly positioned. The hooks 13 are able to be disconnected from the casing 1 of the iron by the actuation of operating buttons 14 integral with the hooks 13.

The distribution chamber 6, fixed for example to the thermal shield 5 and in which a drip feed device 15 is mounted, has an opening 16 designed to communicate with the water outlet orifice 11 through a pipe 17. The steam iron also comprises two valves 18 and 19 fitted respectively to the opening 16 in the distribution chamber 6 and the water outlet orifice 11, and two reciprocal means 20 and 21 for actuating the valves 18 and 19, adapted for opening the valves 18 and 19 when the reservoir 7 is locked in the casing 1.

According to the invention, one of the valves 18 has a movable shutter 22 and a fixed seat 23, the other valve 19 has a fixed shutter 24 and a movable seat 25, and the two actuation means 20 and 21 are adapted for coming into engagement, when the reservoir 7 is locked in the casing 1, on the one hand with the movable shutter 22 and on the other hand with the movable seat 25.

The valve 19 with the fixed shutter 24 and movable seat 25 comprises a sleeve 26 mounted so as to be movable and having an annular shoulder 27 forming the movable seat 25 for the fixed shutter 24 and able to occupy two positions in which either the sleeve 26 occupies a first position in which the water reservoir is disconnected from the casing 1 and the movable seat 25 is in contact with the fixed shutter 24 to form a watertight joint, or the sleeve occupies a second position in which the reservoir 7 is fixed by the locking means 8 and the fixed shutter 24 opens the movable shutter 25 so that the water in the reservoir 7 flows freely into the distribution chamber 6.

The valve 19 is fitted to the opening 16 in the distribution chamber 6 and the valve 18 is fitted to the water outlet orifice 11 in the reservoir 7. The valve 19 also has an annular base 28 fitted into the opening 16 as far as a stop 29 formed on the base 28 and a column 30 which is fixed partially onto the base 28 and which is integral with the fixed shutter 24.

Figure 2:
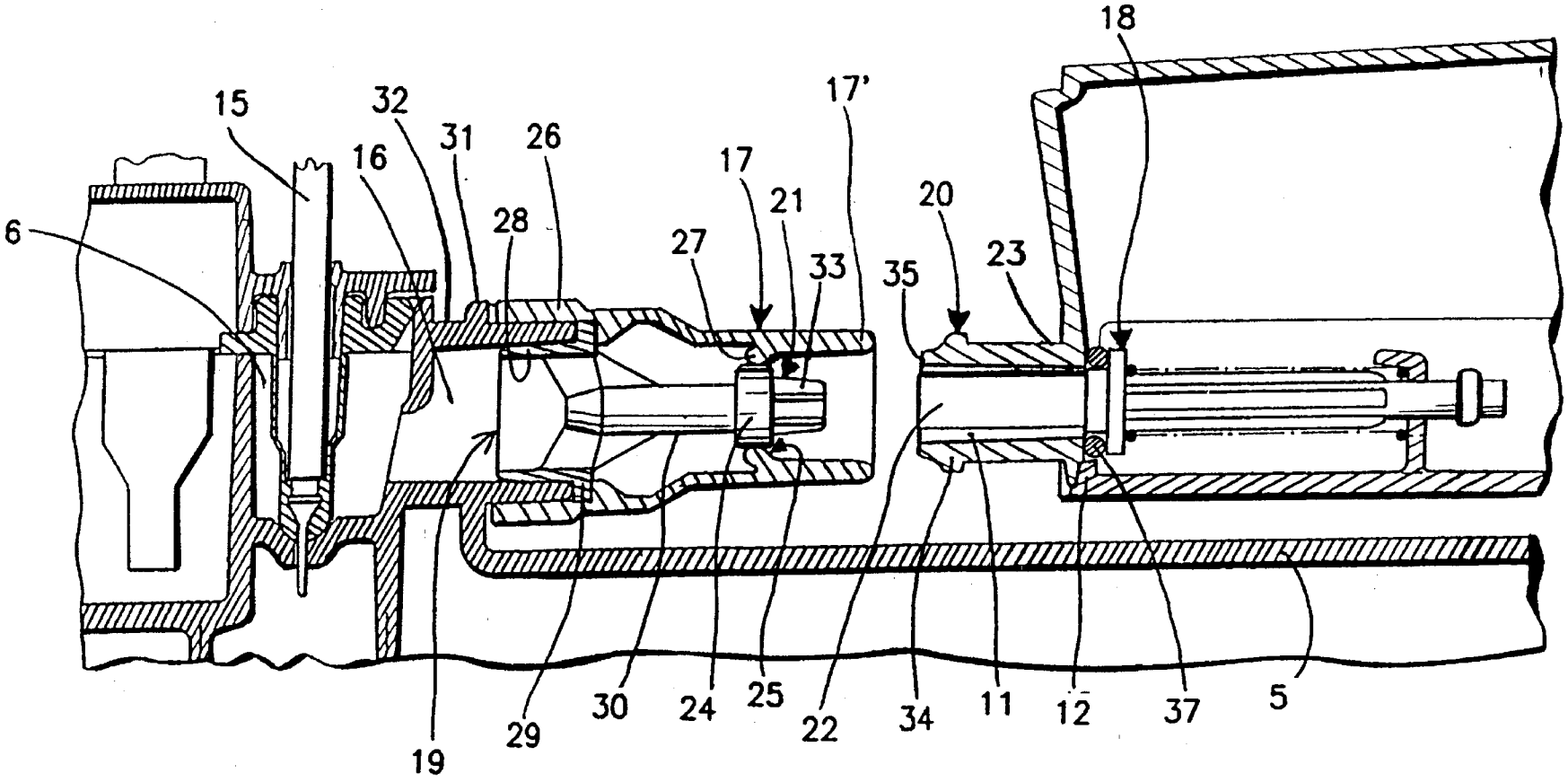
FIG. 2 is a cut-away view of the enlarged lower part of the steam iron according to the invention, in which the removable reservoir is not fully in position in the casing of the iron.
Figure 3:
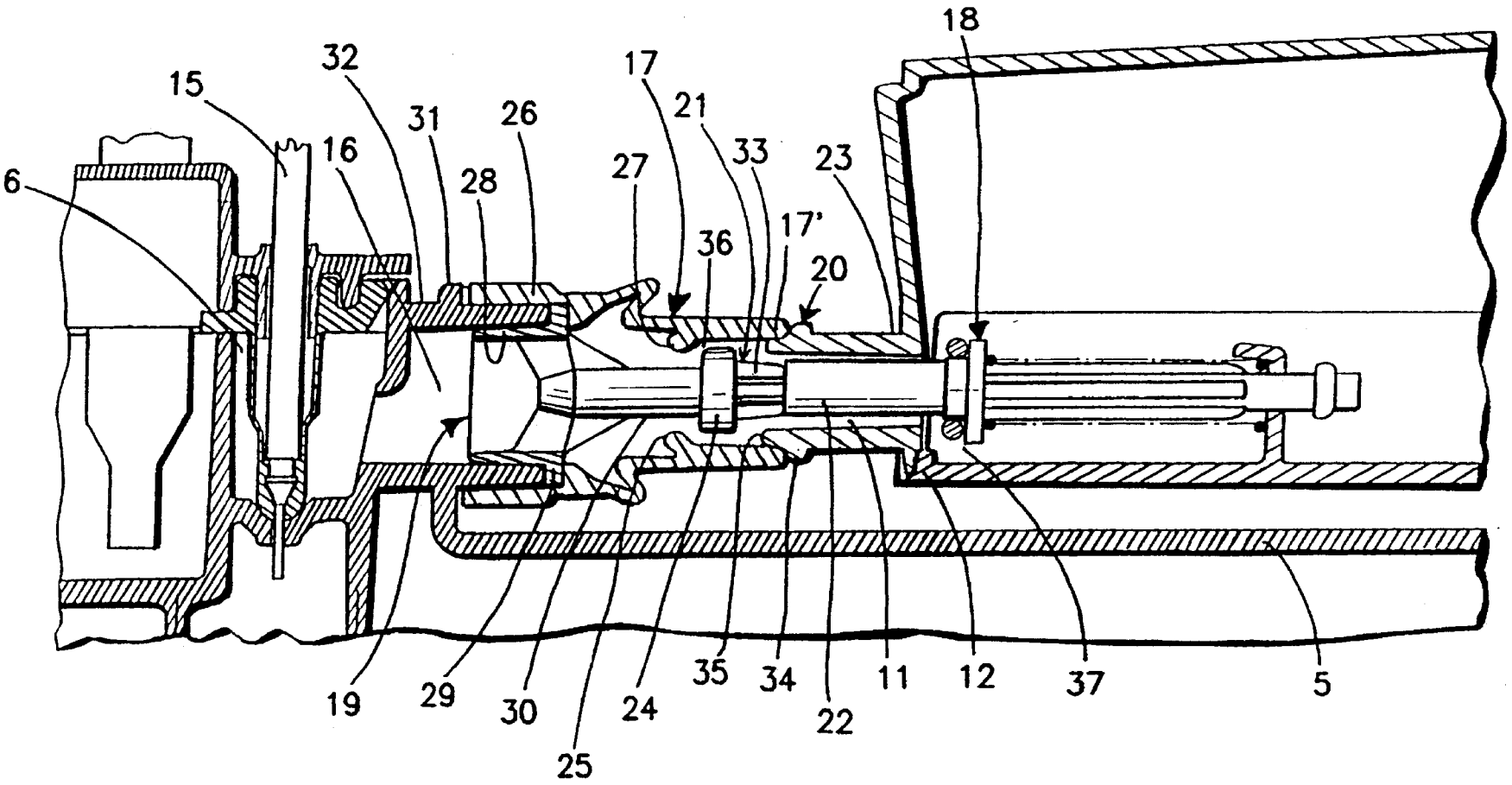
FIG. 3 is a cut-away view of the enlarged lower part of the iron according to the invention, in which the removable reservoir is locked in the casing.

According to a preferred embodiment illustrated in FIGS. 1, 2 and 3, the sleeve 26 is formed by a flexible piece in an elastomer body, for example silicone. The sleeve 26 fits onto the opening 16 in the distribution chamber 6 as far as another stop 31 formed on the periphery 32 of the opening 16. In this way, the sleeve 26 covers the valve 19 and occupies on the one hand an extended idle position in a first position and on the other hand a retracted position in the second position.

The actuation means 20 and 21 comprise on the one hand a finger 33 fixed to the fixed shutter 24, directed outwards and designed to open the movable shutter 22 in the extended idle position and, on the other hand, a spout 34 integral with the fixed shutter 23 and the end 35 of which is adapted for coming into contact with the free end 17' in the retracted position.

In order to give a better understanding of the invention, the functioning of the iron according to the invention which is illustrated in FIGS. 2 and 3, where the same reference numerals designate the same components, will be described.

According to FIG. 2, before the complete fitting of the removable reservoir 7 into the casing 1 of the steam iron, the sleeve 26 occupies an extended idle position corresponding to the first position. In this first position, the end 17' of the sleeve 26 is in contact with the fixed shutter 24 through the annular shoulder 27 formed inside the sleeve 26, thus closing off the distribution chamber 6 in a watertight manner. This complete watertightness thus prevents any flow of water inside the casing which on the one hand would be detrimental to the service life of the iron and on the other hand unpleasant for the user.

According to FIG. 3, when the removable reservoir 7 is locked in the casing 1, the spout 34 of the fixed seat 23 comes into contact with the free end 17' of the flexible sleeve 26 and exerts a force on the sleeve 26 so as to cause it to occupy a retracted position corresponding to the second position. In this way, the annular shoulder 27 is no longer in abutment against the fixed shutter 24, which thus leaves clear a passage space 36. At the same time, the finger 33 fixed to the fixed shutter 24 pushes the movable shutter 22 of the valve 18, which is fitted with a sealing joint 37 completely closing off the removable reservoir 7 when the reservoir 7 is not locked in the casing 1 of the iron. The sealing joint 37 no longer bearing against the internal part of the water outlet orifice 11 in the reservoir 7, the water in the reservoir 7 flows through the water outlet orifice 11, enters the sleeve 26 through the passage space 36 and emerges into the opening 16 in the distribution chamber 6. The sleeve 26 thus fulfils the role of the pipe 17.

By virtue of the embodiment of the invention, the sleeve 26 by itself provides, on the one hand, the closure of the distribution chamber 6 when the removable reservoir 7 is not fitted into the casing 1 of the iron and, on the other hand, the watertightness of the pipe 17 when the reservoir 7 is locked in the casing of the iron.

We claim:

1. Steam iron comprising a casing in which a water reservoir is removably mounted, means for locking the reservoir in the casing, a filling orifice formed in a top part of said reservoir, and a water outlet orifice formed in a bottom part of said reservoir, a distribution chamber in which a drip feed device is mounted, said distribution chamber having an opening which communicates with the water outlet orifice through a pipe, a first valve being fitted to the water outlet orifice, a first reciprocal means for actuating the first valve suitable for opening the first valve when the reservoir is locked in the casing, a second valve being provided to close the opening, a second reciprocal means for actuating the second valve, one of the two valves having a movable shutter and a fixed seat, the other valve having a fixed shutter and a movable seat, and the two reciprocal actuating means being adapted to come into engagement, when the reservoir is locked in the casing, with the movable shutter and with the movable seat.

2. Steam iron according to claim 1, wherein the valve with the fixed shutter and movable seat comprises a sleeve mounted so as to be movable and having an annular shoulder forming the movable seat for the fixed shutter, said sleeve adapted to occupy two positions in which in a first position the reservoir is disconnected from the casing and the movable seat is in contact with the fixed shutter to form a watertight joint, and in a second position the reservoir is fixed by the locking means and the fixed shutter opens the movable shutter so that water in the reservoir flows freely into the distribution chamber.

3. Steam iron according to claim 2, wherein the second valve comprises the sleeve and is fitted to the opening in the distribution chamber, and the first valve with the movable shutter and fixed seat is fitted to the water outlet orifice in the reservoir.

4. Steam iron according to claim 3, wherein the sleeve fitted to the opening is formed by a flexible piece which fits onto said opening, which covers the second valve having the fixed shutter and movable seat, and which occupies an extended idle position in the first position, and a retracted position in the second position.

5. Steam iron according to claim 4, wherein the flexible piece is formed in an elastomer body.

6. Steam iron according to claim 4, wherein the sleeve has a free end, and in the extended idle position, said free end is in contact with the fixed shutter through the annular shoulder formed inside the sleeve, thus closing off the distribution chamber in a watertight manner, and in the retracted position, the water outlet orifice in the reservoir exerts a force on said free end of the sleeve, releasing the annular shoulder of the fixed shutter and creating a passage space.

7. Steam iron according to claim 6, wherein the two reciprocal actuation means comprise a finger fixed to the fixed shutter, directed outward and designed to open the movable shutter in the first position, and a spout integral with the fixed seat and having an end which is adapted to come into contact with a free end of the sleeve in the second position.

* * * * *